US006336240B1

(12) United States Patent
Laux et al.

(10) Patent No.: US 6,336,240 B1
(45) Date of Patent: Jan. 8, 2002

(54) MODULAR SPONGE MOP

(75) Inventors: Christopher J. Laux, Hamilton; Paul P. Kolada, Berley; Mark E. Maich; Dana J. Koppes, both of Columbus, all of OH (US)

(73) Assignee: O'Cedar Brands, Inc., Springfield, OH (US)

( * ) Notice: Subject to any disclaimer, the term of this patent is extended or adjusted under 35 U.S.C. 154(b) by 0 days.

(21) Appl. No.: 09/454,045

(22) Filed: Dec. 3, 1999

(51) Int. Cl.[7] ..... A47L 13/12; A47L 13/14; A47L 13/17; A47L 13/20

(52) U.S. Cl. ..... 15/104.94; 15/115; 15/116.2; 15/118; 15/119.2; 15/121

(58) Field of Search ..... 15/104.94, 114, 15/115, 116.2, 117, 118, 119.2, 121

(56) References Cited

U.S. PATENT DOCUMENTS

| | | | | | |
|---|---|---|---|---|---|
| 2,304,127 | A | * | 12/1942 | Stetson | 15/118 X |
| 2,641,787 | A | | 6/1953 | Vosbikian et al. | 15/116.2 |
| 2,694,824 | A | | 11/1954 | Kalinowski | 15/116.2 |
| 2,730,741 | A | | 1/1956 | Gantz | 15/116.2 |
| 2,858,557 | A | | 11/1958 | Zottcla | 15/119.2 |
| 3,050,761 | A | * | 8/1962 | Morgan | 15/119.2 |
| 3,157,901 | A | | 11/1964 | Murphy | 15/244.1 |
| 3,161,905 | A | | 12/1964 | Dryden | 401/204 |
| 3,896,518 | A | * | 7/1975 | Von Post et al. | 15/104.94 |
| 4,491,998 | A | | 1/1985 | Wilson et al. | 15/119.2 |
| 4,523,347 | A | * | 6/1985 | Tames | 15/104.94 |
| 4,569,861 | A | | 2/1986 | Smith et al. | 427/244 |
| 4,581,287 | A | | 4/1986 | Smith et al. | 428/290 |
| 4,601,081 | A | * | 7/1986 | Sutton et al. | 15/104.94 |
| 4,604,767 | A | | 8/1986 | Burkhart et al. | 15/119.2 |
| 4,793,019 | A | * | 12/1988 | Stima et al. | 15/104.94 |
| 5,024,325 | A | * | 6/1991 | Gundlach | 15/104.94 X |
| 5,080,517 | A | * | 1/1992 | Lynn | 15/118 X |
| 5,097,561 | A | | 3/1992 | Torres | 15/119.2 |
| 5,483,720 | A | | 1/1996 | Decoopman et al. | 15/119.2 |
| 5,488,750 | A | | 2/1996 | Vosbikian et al. | 15/119.2 |
| 5,522,110 | A | | 6/1996 | Borofsky | 15/116.2 |
| 5,655,248 | A | | 8/1997 | Kieson et al. | 15/119.2 |
| 5,896,613 | A | | 4/1999 | Courtney et al. | 15/119.2 |
| 5,920,942 | A | | 7/1999 | Footer | 15/121 |

FOREIGN PATENT DOCUMENTS

| | | | | |
|---|---|---|---|---|
| DE | 3400625 | * | 5/1984 | 15/118 |

* cited by examiner

*Primary Examiner*—Mark Spisich
(74) *Attorney, Agent, or Firm*—Biebel & French

(57) ABSTRACT

A mop having a mop head with a first sponge member supported to a bottom side thereof and defining a first floor engaging surface. A second sponge member is supported on the mop head and defines a second floor engaging surface. The second sponge member retains a releasable cleaning substance for facilitating cleaning of a surface engaged by the mop. In addition, the second sponge member forms a replaceable auxiliary member which is detachably mounted to the mop head and includes hinged retention members for engaging within receptor passages defined in the mop head wherein the retention members facilitate engagement with and disengagement from the mop head.

22 Claims, 6 Drawing Sheets

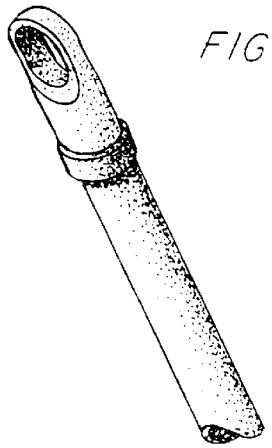
FIG-1
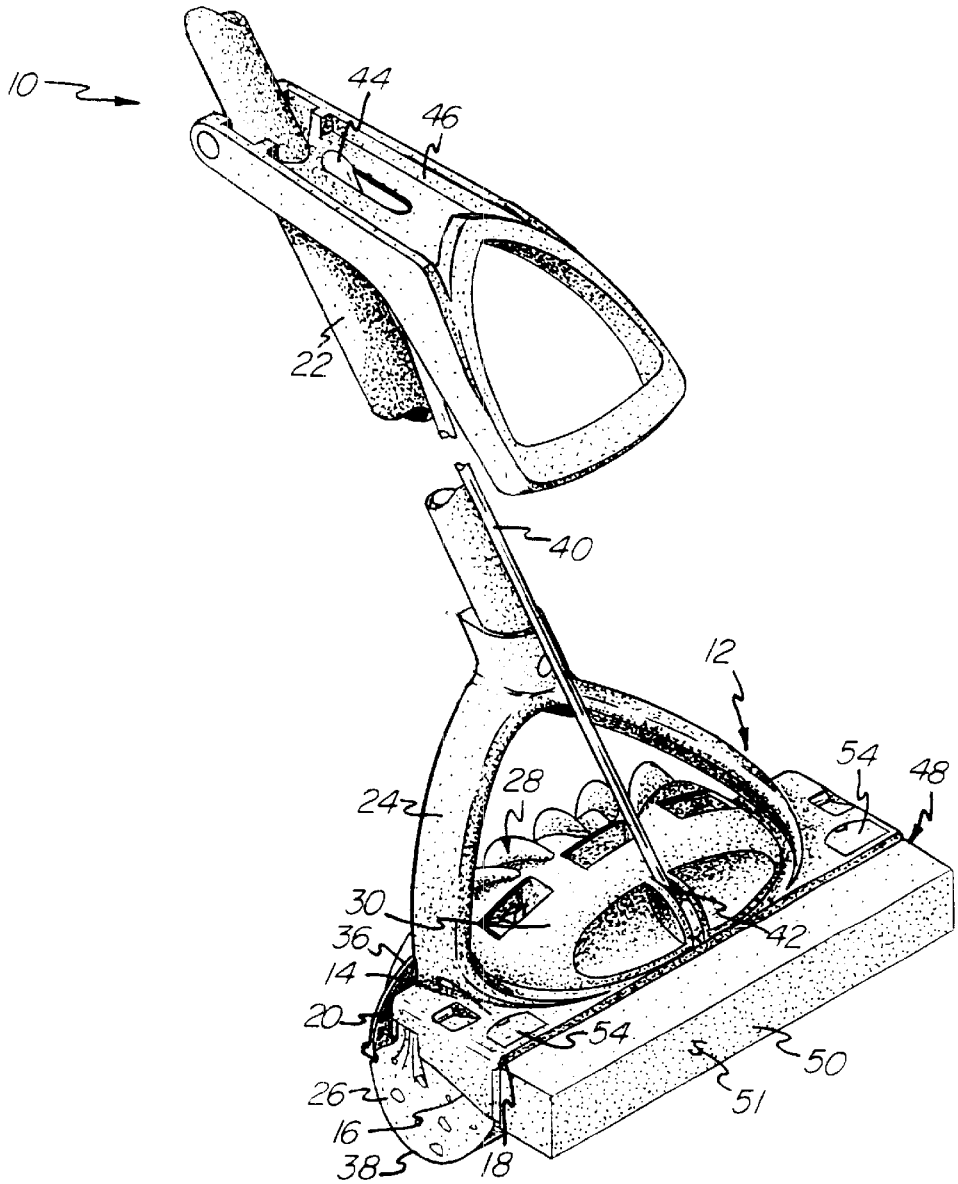

MODULAR SPONGE MOP

BACKGROUND OF THE INVENTION

The present invention generally relates to sponge mops, and more particularly, to a sponge mop incorporating an auxiliary member, in addition to a conventional cleaning sponge, to provide an additional cleaning or scrubbing action for the mop.

Sponge mops are well known and generally include a mop handle supporting a mop head for engaging a sponge member of the mop with a floor surface or other surface to be cleaned. The sponge member is typically formed of polyester or similar material which readily retains fluids, as well as releases the fluids when a wringing pressure is applied against the sponge member. In addition, prior art mops have incorporated additional cleaning members, such as scrub strips and brushes, to facilitate a cleaning operation by providing an abrasive action not normally available through use of the sponge member.

There is a continuing need for an auxiliary member for attachment to a mop, and in particular there is a continuing need for an improved auxiliary member which facilitates the cleaning action already provided by the sponge member of the mop. There is also a need for an auxiliary cleaning member which is detachably mounted to a mop and which may be readily replaced with a similar replacement member or by an alternative form of cleaning member to enable the mop to be selectively constructed with any one of a variety of auxiliary cleaning functions.

SUMMARY OF THE INVENTION

In accordance with the present invention, a mop is provided including a mop head and a handle attached to an upper or top side of the mop head, a first sponge member is supported on the mop head adjacent a bottom side thereof and defines a first floor engaging surface. A second sponge member is supported on the mop head and defines a second floor engaging surface and is adapted to retain a releasable cleaning substance for facilitating cleaning of a surface engaged by the mop.

In a further aspect of the invention, the cleaning substance comprises an aqueous emulsion which is contained within the second sponge member. Upon use of the second sponge member, such as upon application of water to the second sponge member, the aqueous emulsion is released to provide for additional cleaning action on the surface being mopped.

In another aspect of the invention, the second sponge member comprises a foam sponge material, such as a hydrophilic foam material, and the foam includes cell walls integrally incorporating an emulsion comprising a surfactant.

In yet another aspect of the invention, abrasive particles are dispersed through the second sponge member wherein the abrasive particles provide an abrasive texture to the second sponge member.

In an additional aspect of the invention, a mop is provided including a mop head supporting a first sponge member and an auxiliary member detachably supported on the mop head wherein the auxiliary member includes a backing plate and a floor engaging member attached to the backing plate. A hinged retention structure is supported on and is movable relative to the backing plate wherein the hinged retention structure is received through a receptor structure on the mop head to hold the auxiliary member in position on the mop head.

The detachable mounting structure for the auxiliary member permits the auxiliary member to be replaced by a similar auxiliary member or by an auxiliary member performing a different function. For example, the auxiliary member may comprise a second sponge member, or may comprise a brush member, a squeegee, or other structure for performing an auxiliary cleaning operation.

Therefore, it is an object of the present invention to provide a mop including a first sponge member and a second sponge member wherein the second sponge member includes a releasable cleaning substance.

It is a further object of the invention to provide a mop including a mop head supporting a sponge member and an auxiliary member detachably supported on the mop head.

Other objects and advantages of the invention will be apparent from the following description, the accompanying drawings and the appended claims.

BRIEF DESCRIPTION OF THE DRAWINGS

FIG. 1 is a perspective view of the mop of the present invention;

DETAILED DESCRIPTION OF THE PREFERRED EMBODIMENT

Figure 8:
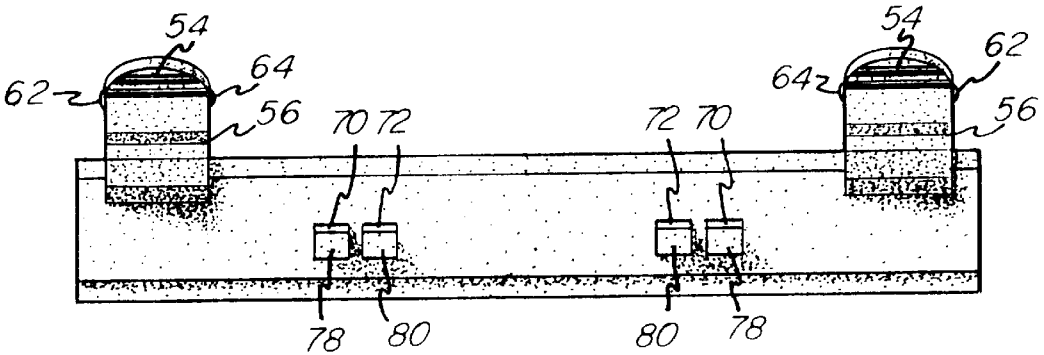
FIG. 8 is a rear elevational view of the sponge auxiliary member.

Referring to FIG. 1, the mop 10 of the present invention generally includes a mop head 12 having a top side 14, an opposing bottom side 16, and opposing front and rear edges 18 and 20. An elongated handle 22 is attached to the mop head 12 at the upper end of a yoke shaped portion 24 of the mop head 12.

A main or first sponge member 26 is removably mounted to the bottom side 16 of the mop head 12. The first sponge member 26 is preferably formed of a polyester material, or other conventional sponge material, which is adapted to readily absorb fluids, as well as release fluids upon application of a pressure to the sponge 26 during a mop wringing operation.

Figure 5:
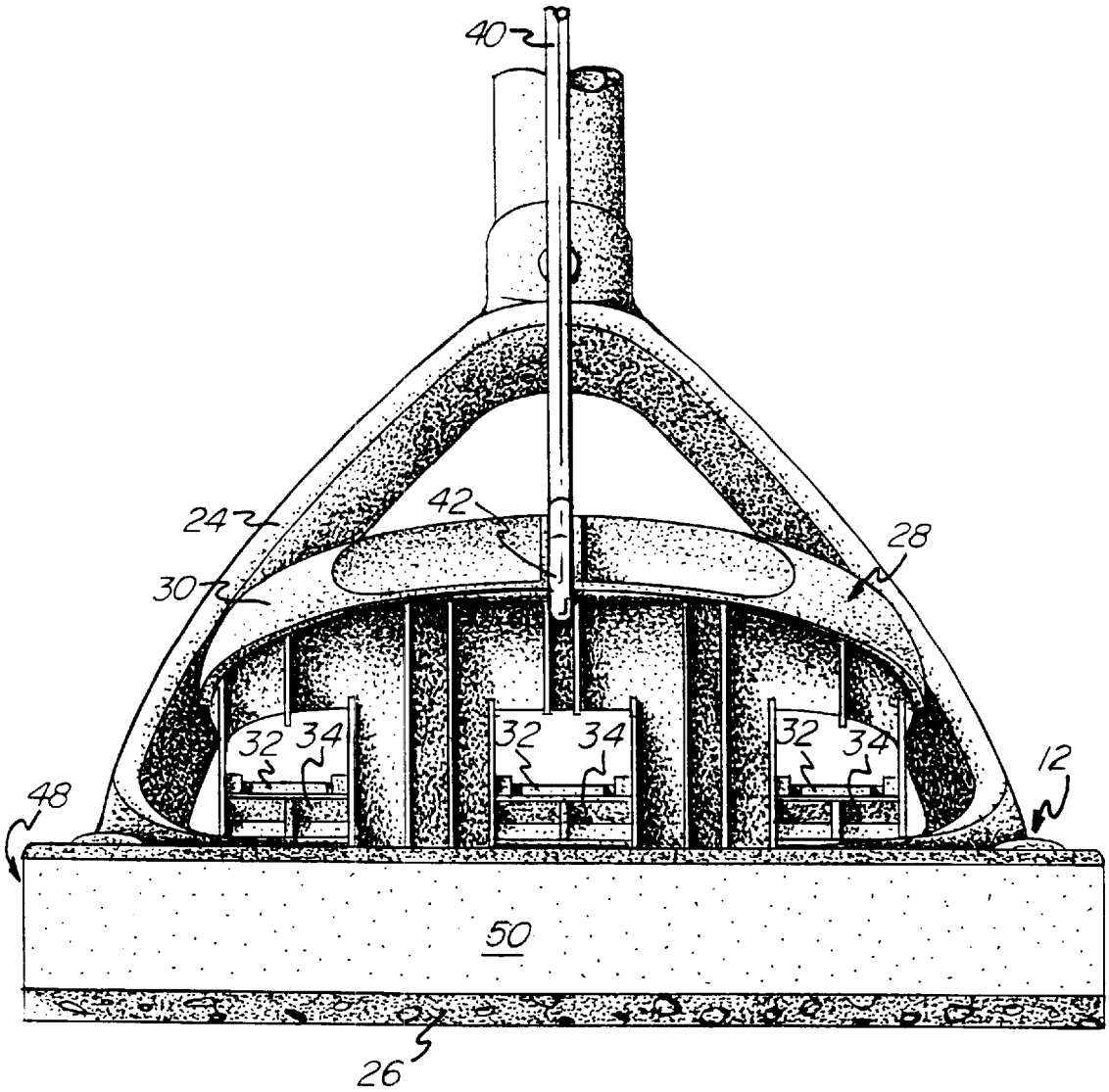
FIG. 5 is a front view of the mop head with the wringing member pivoted to its wringing position.

In accordance with the embodiment shown herein, a mop wringing member 28 is supported on the top side 14 of the mop head 12. As may be seen in FIG. 5, the wringing member 28 includes an upper portion 30 having concave hinge areas 32 for receiving and partially surrounding hinge shafts 34 which are formed integrally with the mop head 12 wherein the shafts 34 are rotatably received within the hinge areas 32. The wringing member 28 is thus held for pivotal movement by the hinge areas 32 which snap fit over the shafts 34. In addition, a wringer plate 36 is formed integrally with the top portion 30 of the wringing member 28 and extends behind the rear edge 20 of the mop head 12 to engage a rear side of the sponge member 26 rearwardly of a floor engaging surface 38 of the sponge member 26. The wringing member 28 is moved to the position shown in FIG. 5 by means of a rod 40 having an end 42 pivotally connected to the top portion of the wringer member 28, and having an opposing end 44 pivotally connected to an actuation handle 46 which is pivotally connected to the elongated handle 22. Thus, pivotal movement of the handle 46 causes the wringer member 28 to squeeze the first sponge member 26 and thereby release fluid therefrom.

Figure 2:
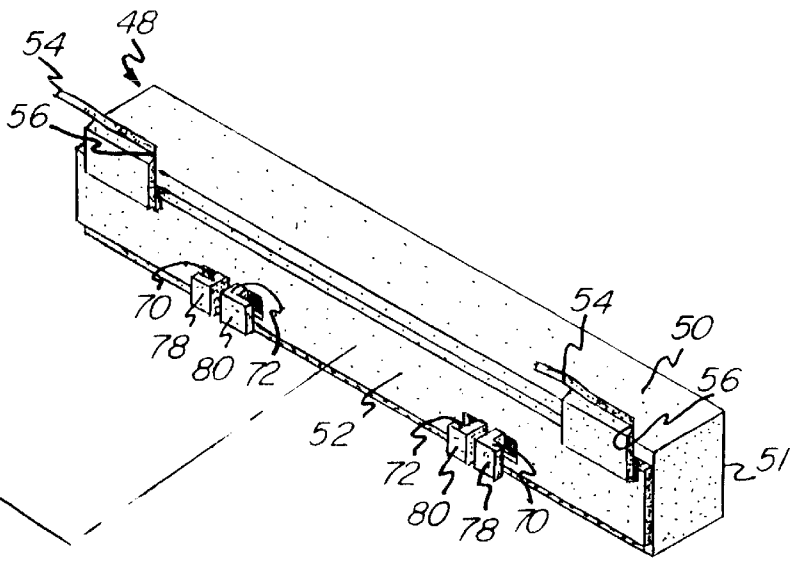
FIG. 2 is a top perspective, partially exploded view of the mop head showing a sponge auxiliary member in spaced relation to the mop head.
Figure 2:
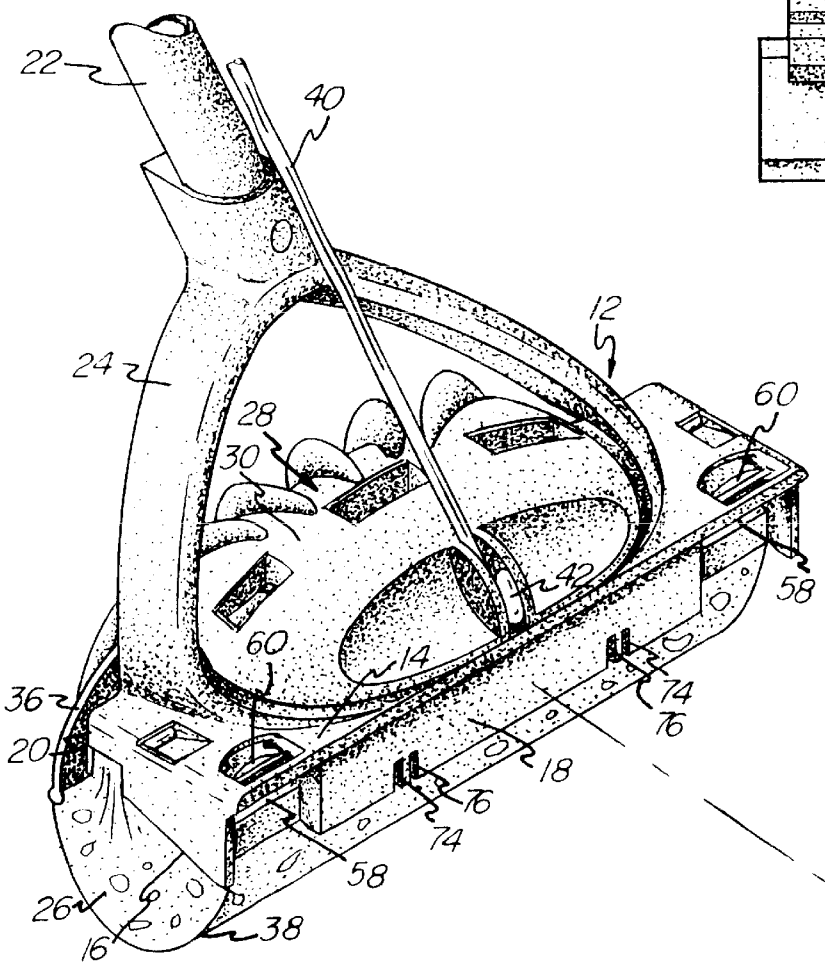

Referring to FIGS. 1 and 2, an auxiliary member 48 is supported on the front edge 18 of the mop head 12, and in the preferred embodiment, the auxiliary member 48 comprises a second sponge member 50 supported on a backing plate 52 and defining a second floor engaging surface 51. In an especially preferred embodiment, the sponge 50 comprises an open-celled, reticulated hydrophilic polyurethane foam material wherein the cell walls integrally incorporate a gelled aqueous emulsion comprising a non-ionic surfactant. In addition, the foam further preferably comprises abrasive particles dispersed through the foam. Such a material is disclosed in U.S. Pat. No. 4,581,287, the disclosure of which patent is incorporated herein by reference.

Thus, the present invention generally provides an additional sponge member containing a releasable cleaning substance for facilitating cleaning of a surface engaged by the mop. It should be understood that other sponge constructions and cleaning substances may be provided in addition to that described above in order to provide a cleaning accessory which facilitates cleaning a surface, such as a floor surface, as an alternative to prior art scrubbing devices which rely substantially on the cleaning force applied to a scrubbing material, such as an abrasive material or brush.

The auxiliary member 48 is removably mounted to the mop head 12 by means of a retention structure on the backing plate 52 cooperating with a receptor structure defined on the front edge 18 of the mop head 12. In particular, and as is further illustrated in FIG. 8, the backing plate 52 includes a pair of tabs 54 which are integrally attached to an upper edge of the backing plate 52 through hinge portions 56 wherein the backing plate 52, hinge portions 56 and tabs 54 may be formed of a molded plastic material.

Figure 4:
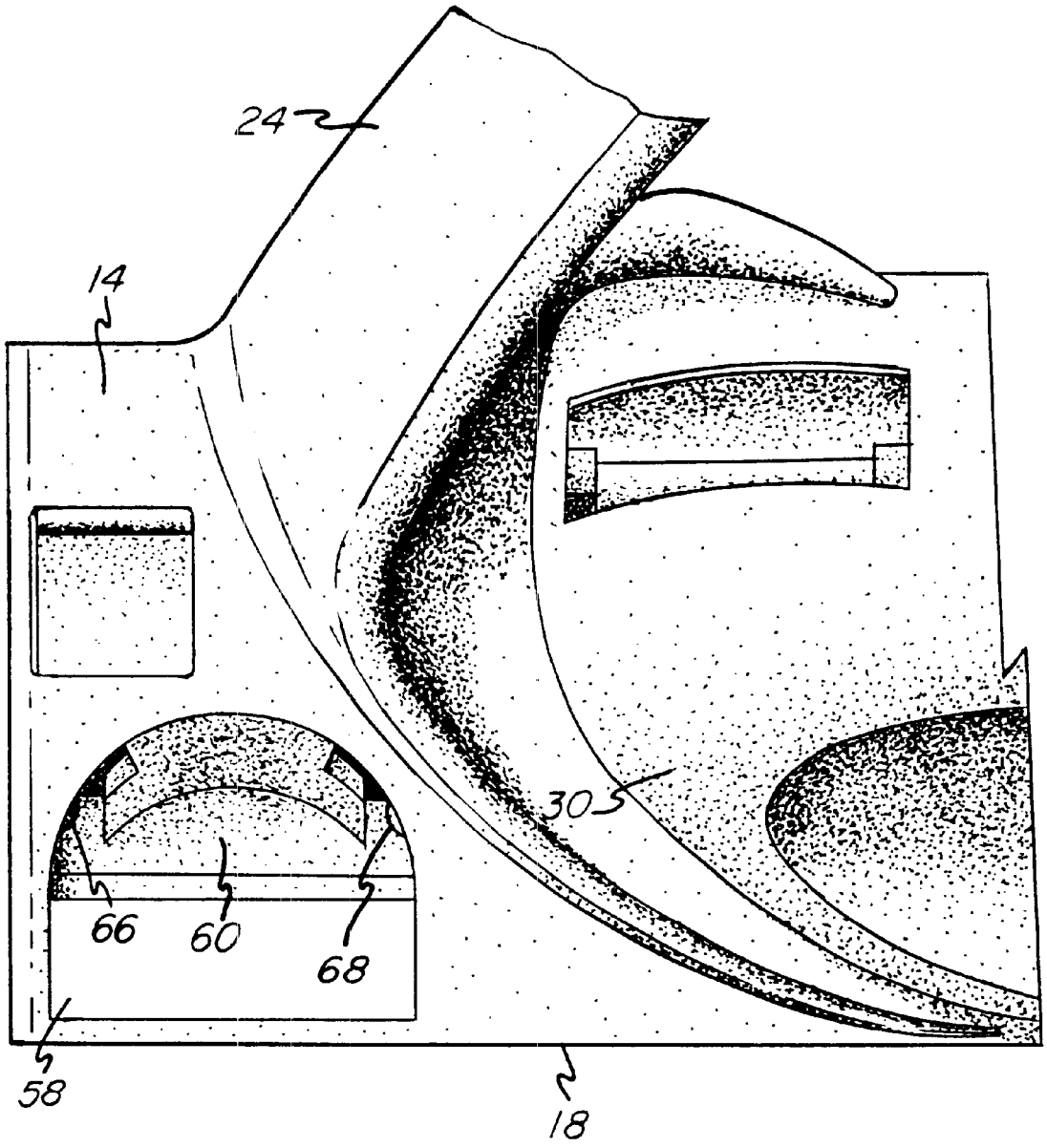
FIG. 4 is a top plan view of a front comer of the mop head.

Referring additionally to FIG. 4, the receptor structure in the mop head 12 comprises passages 58 located adjacent the front corners of the mop head 12 and extending between the front edge 18 and the top side 14. The passages 58 are adapted to receive the tabs 54 therethrough, and the tabs 54 are further received within recesses 60 defined in the top surface 14 of the mop head. During mounting of the accessory member 48 to the mop head 12, the tabs 54 are pivoted downwardly into the recesses 60, and the tabs 54 preferably include a pair of outwardly extending nub portions 62, 64 (FIG. 8) for catching underneath corresponding ledge areas 66, 68 defined within the recesses 60 to thereby retain the tabs 54 in their downwardly pivoted position.

Figure 3:
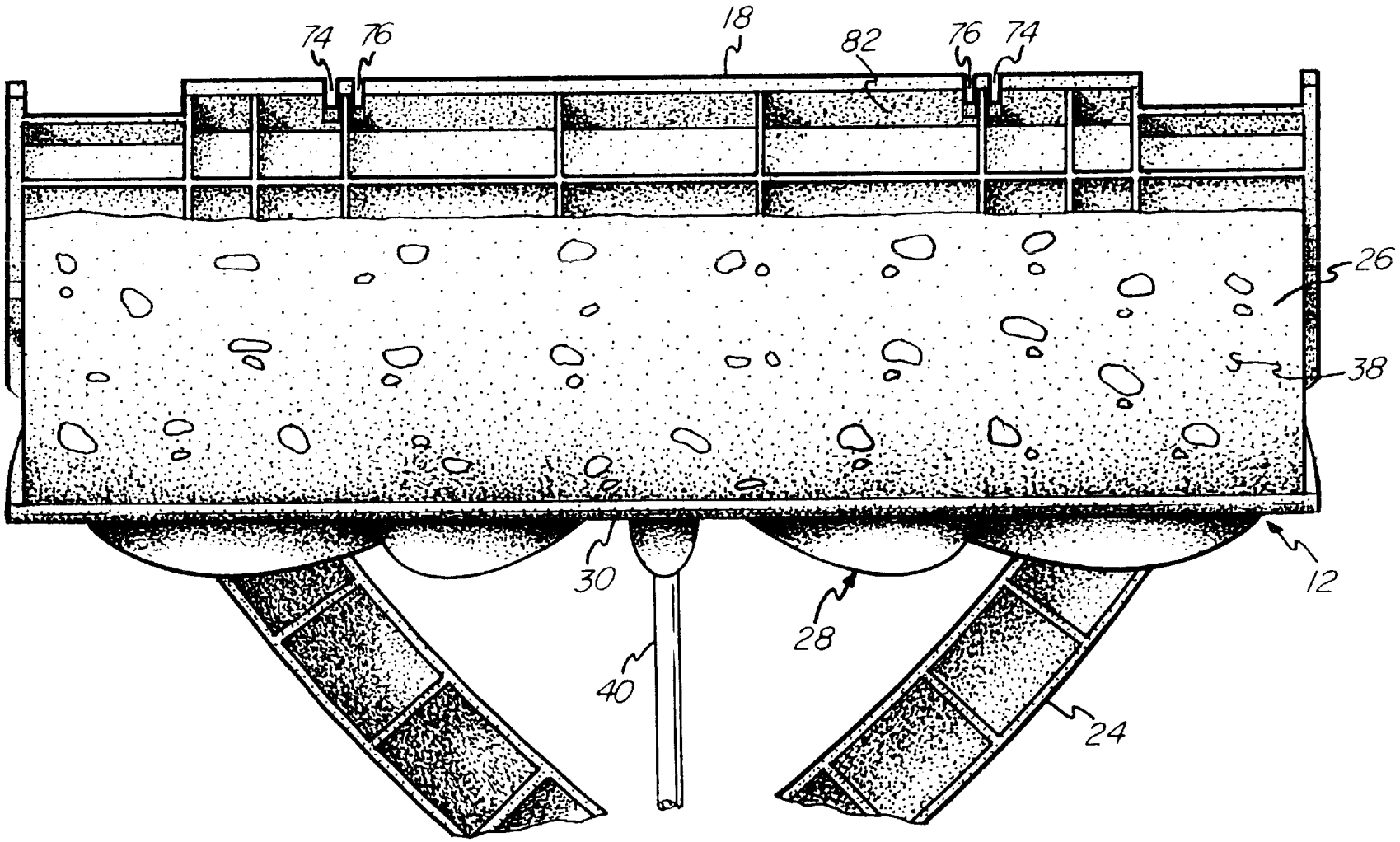
FIG. 3 is a bottom view of the mop head with the front edge of the main sponge member partially cut away to show the front mounting edge for the auxiliary member.

As may be best seen in FIGS. 2 and 8, the backing plate 52 further includes a pair of spaced legs 70, 72 located adjacent opposing lateral sides of the backing plate 52. The legs 70, 72 are adapted to slide through corresponding slots 74, 76 extending into the front edge 18 from the lower side thereof. In addition, each of the legs 70, 72 includes a respective tang portion 78, 80 extending perpendicularly thereto. The tang portions 78, 80 engage a back surface 82 (FIG. 3) of the front edge 18 whereby the backing plate 52 is held in contact with the front edge 18 as it is inserted upwardly to engage the legs 70, 72 within the slots 74, 76. Further, during the upward movement of the backing plate 52 along the front edge 18, the tabs 54 are engaged with and guided through the passages 58 to position the tabs 54 for engagement within the recesses 60. Thus, the auxiliary member 48 is positively locked in position on the front edge 18 of the mop head 12.

Figure 6:
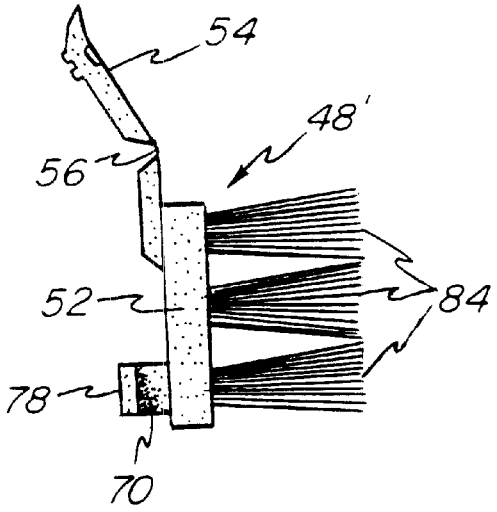
FIG. 6 is a side elevational view of a brush auxiliary member for attachment to the mop head.

Referring to FIG. 6, an alternative embodiment of the auxiliary member is illustrated and is identified with the reference numeral 48'. The auxiliary member 48' includes a backing plate 52 having an identical construction to that of the backing plate 52 of the auxiliary member 48 previously described. In the embodiment of FIG. 6, the auxiliary member 48' provides a brush 84 attached to the backing plate 52. The brush 84 extends outwardly from and longitudinally along the length of the backing plate 52 to provide a scrubbing element for use in combination with the main sponge member 26 to clean a floor surface.

Figure 7:
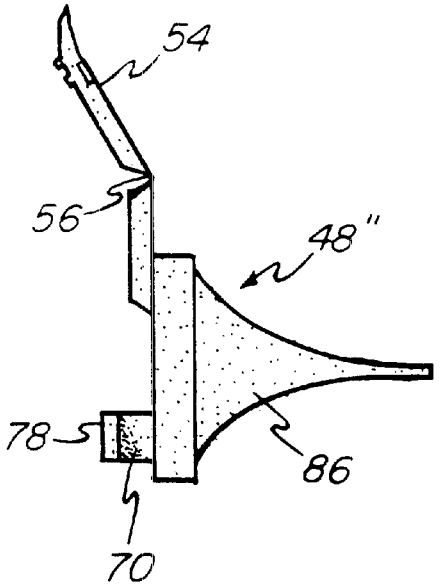
FIG. 7 is a side elevational view of a squeegee auxiliary member for attachment to the mop head.

Referring to FIG. 7, a further alternative embodiment of the auxiliary member is illustrated and is identified with the reference numeral 48". The auxiliary member 48" includes a backing plate 52 identical in construction to the previous embodiments and supporting a squeegee element 86. The squeegee element 86 extends outwardly from and along the length of the backing plate 52 and provides a squeegee or wiping member to facilitate wiping fluids on a floor surface.

In view of the above description, it should be apparent that the present invention provides an auxiliary member for attachment to a mop and for use in combination with a main sponge member. In particular, in the preferred embodiment, the present invention provides an auxiliary sponge member which releasably retains a cleaning solution for enhancing the cleaning performance of the mop. In addition, the present invention provides a unique structure for releasably retaining an auxiliary member on a mop head whereby the auxiliary member may be replaced by a new member or by a different member for performing a different function in combination with the mop sponge.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A mop comprising:

a mop head having opposing top and bottom sides, and opposing front and rear edges;

a handle including an end attached to said mop head adjacent said top side;

a first sponge member supported on said mop head adjacent said bottom side and defining a first floor engaging surface;

an auxiliary member comprising a second, sponge member supported on a backing plate, said second sponge member retaining a releasable cleaning substance;

wherein said backing plate is engaged with one of said front and rear edges of said mop head and is held in position, separate from said first sponge member, by a detachable locking structure for detachably connecting said auxiliary member to said mop head; and wherein said mop head includes passages formed in said one of said edges, and said backing plate includes retention members engaging within said passages to hold said backing plate in position on said one of said edges.

2. The mop as recited in claim 1 wherein said cleaning substance comprises an aqueous emulsion.

3. The mop as recited in claim 1 including abrasive particles dispersed through said second sponge member providing an abrasive texture to said second sponge member.

4. The mop as recited in claim 1 wherein said second sponge member comprises a foam sponge material.

5. The mop as recited in claim 4 wherein said foam sponge material comprises a hydrophilic foam material.

6. The mop as recited in claim 5 wherein said foam material includes cell walls integrally incorporating an aqueous emulsion.

7. The mop as recited in claim 1 wherein said second sponge member comprises an open-celled, reticulated hydrophilic polyurethane foam.

8. The mop as recited in claim 7 wherein said foam includes cell walls integrally incorporating a gelled aqueous emulsion comprising a nonionic surfactant.

9. The mop as recited in claim 8 wherein said foam further comprises abrasive particles dispersed through said foam.

10. The mop as recited in claim 1 wherein said retention members comprise hinged portions pivotally moveable relative to said backing plate, and said mop head comprises recesses in said top side, said recesses in communication with said passages for receiving and retaining said hinged portions in engagement with said mop head.

11. The mop as recited in claim 1 wherein said mop head further includes slots formed in said one of said edges for slidably receiving legs extending from said backing plate, said legs including tang portions slidably received behind said at least one edge for retaining said backing plate for sliding movement along said at least one edge.

12. The mop as recited in claim 1 wherein said second sponge member is located adjacent said front edge of said mop head.

13. A mop comprising:

a mop head having opposing top and bottom sides, and opposing front and rear edges;

a handle including an end attached to said mop head adjacent said top side;

a sponge member supported on said mop head adjacent said bottom side;

an auxiliary member detachably supported on said mop head adjacent one of said edges, said auxiliary member including a backing plate and a floor engaging member attached to said backing plate;

a hinged retention structure supported on and moveable relative to said backing plate; and said one of said edges including a receptor structure for receiving said retention structure to hold said auxiliary member in position on said mop head.

14. The mop as recited in claim 13 wherein said backing plate includes an upper edge located adjacent said top side of said mop head and said retention structure extends from said upper edge of said backing plate.

15. The mop as recited in claim 14 wherein said receptor structure includes passage means extending through said top side and said one of said edges for receiving said retention structure therethrough.

16. The mop as recited in claim 15 including recess means defined in said top side of said mop head for receiving and retaining said retention structure in engagement with said mop head.

17. The mop as recited in claim 15 wherein said passage means comprises a pair of spaced passages and said retention structure comprises a pair of tabs pivotally supported on said backing plate and located for extension through said spaced passages.

18. The mop as recited in claim 13 wherein said mop head further includes slots formed in said one of said edges for slidably receiving legs extending from said backing plate, said legs including tang portions slidably received behind said at least one edge for retaining said backing plate for sliding movement along said at least one edge.

19. The mop as recited in claim 1, wherein said floor engaging member attached to said backing plate comprises a second sponge member comprising a hydrophilic foam material.

20. The mop as recited in claim 19 wherein said foam material includes cell walls integrally incorporating an aqueous emulsion.

21. The mop as recited in claim 13 wherein said floor engaging member attached to said backing plate comprises a brush member.

22. The mop as recited in claim 13 wherein said floor engaging member attached to said backing plate comprises a squeegee.

* * * * *